US011412828B2

(12) United States Patent
Harvey

(10) Patent No.: US 11,412,828 B2
(45) Date of Patent: Aug. 16, 2022

(54) LUGGAGE HANDLE LATERAL DISPLACEMENT ASSEMBLY

(71) Applicant: Willie Harvey, Everett, WA (US)

(72) Inventor: Willie Harvey, Everett, WA (US)

( * ) Notice: Subject to any disclaimer, the term of this patent is extended or adjusted under 35 U.S.C. 154(b) by 155 days.

(21) Appl. No.: 16/929,298

(22) Filed: Jul. 15, 2020

(65) Prior Publication Data

US 2022/0015518 A1 Jan. 20, 2022

(51) Int. Cl.
*A45C 13/22* (2006.01)
*A45C 13/26* (2006.01)

(52) U.S. Cl.
CPC ..... *A45C 13/22* (2013.01); *A45C 13/262* (2013.01); *A45C 2013/223* (2013.01); *Y10T 16/4713* (2015.01)

(58) Field of Classification Search
CPC . A45C 13/22; A45C 2013/223; A45C 13/262; Y10T 16/4713; Y10T 16/4719; Y10T 16/469; Y10T 16/473; Y10T 74/20738
See application file for complete search history.

(56) References Cited

U.S. PATENT DOCUMENTS 572,851 A * 12/1896 Young ..... F16B 4/004 16/427
577,220 A * 2/1897 Whitehead ..... B25J 1/04 24/339
1,503,348 A * 7/1924 Bruhn ..... B62D 1/043 74/557
1,534,075 A * 4/1925 Parrish ..... A01B 1/026 294/58
1,543,332 A * 6/1925 Hopkins ..... B66F 13/00 74/547
4,197,764 A * 4/1980 Auernhammer ..... A01G 3/053 30/340
4,624,206 A * 11/1986 Frye ..... B63H 20/02 74/544
4,656,566 A * 4/1987 Kelley ..... F21L 2/00 215/396
4,911,575 A * 3/1990 Tidwell ..... E04F 21/245 404/112
D316,804 S 5/1991 Foulke
5,040,432 A * 8/1991 Carlstedt ..... B63H 20/12 74/544
5,052,320 A * 10/1991 Cremer ..... B63H 20/12 114/146
5,131,116 A * 7/1992 Bowdler ..... A61F 4/00 16/427
D362,100 S * 9/1995 McMurdo ..... D34/27
5,625,922 A * 5/1997 Morad ..... B25G 3/24 294/58
5,722,118 A * 3/1998 Hansen ..... A45F 5/102 16/113.1

(Continued)

FOREIGN PATENT DOCUMENTS

WO WO2002064919 8/2002

*Primary Examiner* — Jeffrey O'Brien

(57) ABSTRACT

A luggage handle lateral displacement assembly includes a rod that has a first end, a second end and a perimeter wall extending between the first and second ends. A coupler is attached to the rod adjacent to the first end and is mounted on the perimeter wall. The coupler can engage a handle attached to a suitcase such that the second end extends laterally away from the handle.

17 Claims, 5 Drawing Sheets

(56) References Cited

U.S. PATENT DOCUMENTS 5,794,307 A * 8/1998 Overcash ..... B62B 1/18 16/427
5,809,614 A * 9/1998 Kretser, Jr. ..... A01B 1/00 16/422
5,867,868 A * 2/1999 Ward ..... A63B 60/10 294/171
5,878,853 A * 3/1999 DeRouen ..... A45C 13/262 190/116
6,301,749 B1 10/2001 Chen
6,360,402 B1 * 3/2002 Crabtree ..... A45C 13/00 16/431
6,502,873 B1 * 1/2003 Horseman ..... E05B 1/0053 292/336.3
6,550,104 B2 * 4/2003 Cacciacarne ..... B62B 5/06 D34/27
6,578,231 B1 * 6/2003 Godshaw ..... A45F 5/10 24/302
6,704,968 B2 * 3/2004 Lau ..... A01B 1/026 294/58
6,711,784 B2 * 3/2004 Walker ..... A45C 13/00 294/166
6,901,635 B1 * 6/2005 Scola ..... A45F 5/1026 294/171
6,920,667 B2 * 7/2005 Joesten ..... A45C 13/00 16/114.1
6,961,978 B2 * 11/2005 Earley ..... A45C 13/262 16/422
7,657,973 B1 * 2/2010 Hermann ..... B62B 5/06 16/110.1
7,971,914 B1 * 7/2011 Pladson ..... A01B 1/026 294/58
7,975,578 B2 * 7/2011 Youtsey ..... H01R 43/26 81/472
8,060,986 B1 * 11/2011 Green ..... B25F 5/026 30/296.1
8,424,165 B1 * 4/2013 Moad ..... A45C 13/262 16/442
8,540,294 B2 * 9/2013 Dowler ..... B65G 7/12 294/148
8,801,024 B2 * 8/2014 Grainger ..... B62H 7/00 280/292
9,268,355 B2 * 2/2016 Lee ..... E03C 1/0412
9,987,739 B2 * 6/2018 Frascello ..... B25G 3/10
2002/0109364 A1 * 8/2002 Graves ..... A01B 1/026 294/58
2004/0025623 A1 * 2/2004 Dunbar ..... B62B 1/18 74/544

* cited by examiner

LUGGAGE HANDLE LATERAL DISPLACEMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to luggage handle extension device and more particularly pertains to a new luggage handle extension device for positioning a wheeled suitcase laterally away from a user to prevent the suitcase from striking the user's legs as the suitcase is being rolled over a floor surface.

(2) Description of Related Art Including Information Disclosed Under 37 CFR 1.97 and 1.98

The prior art relates to luggage handle extension devices that are typically used to assist a person in gripping a suitcase.

BRIEF SUMMARY OF THE INVENTION

An embodiment of the disclosure meets the needs presented above by generally comprising a rod that has a first end, a second end and a perimeter wall extending between the first and second ends. A coupler is attached to the rod adjacent to the first end and is mounted on the perimeter wall. The coupler can engage a handle attached to a suitcase such that the second end extends laterally away from the handle.

In another embodiment, the disclosure meets the needs of a system including a suitcase having a front wall, a rear wall, a top wall and a bottom wall. A plurality of wheels is attached to the bottom wall. A handle is attached to the suitcase and extends upwardly from a top wall of the suitcase. The handle is positioned between a first lateral wall and a second lateral wall of the suitcase. The handle is elongated along a line extending between the first and second lateral walls. A rod has a first end, a second end and a perimeter wall extending between the first and second ends. The rod has a length from the first end is at least equal to or greater than ½ of a distance from the first lateral wall to the second lateral wall. A coupler is attached to the rod adjacent to the first end and is mounted on the perimeter wall. The coupler engages the handle such that the second end extends laterally away from the handle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
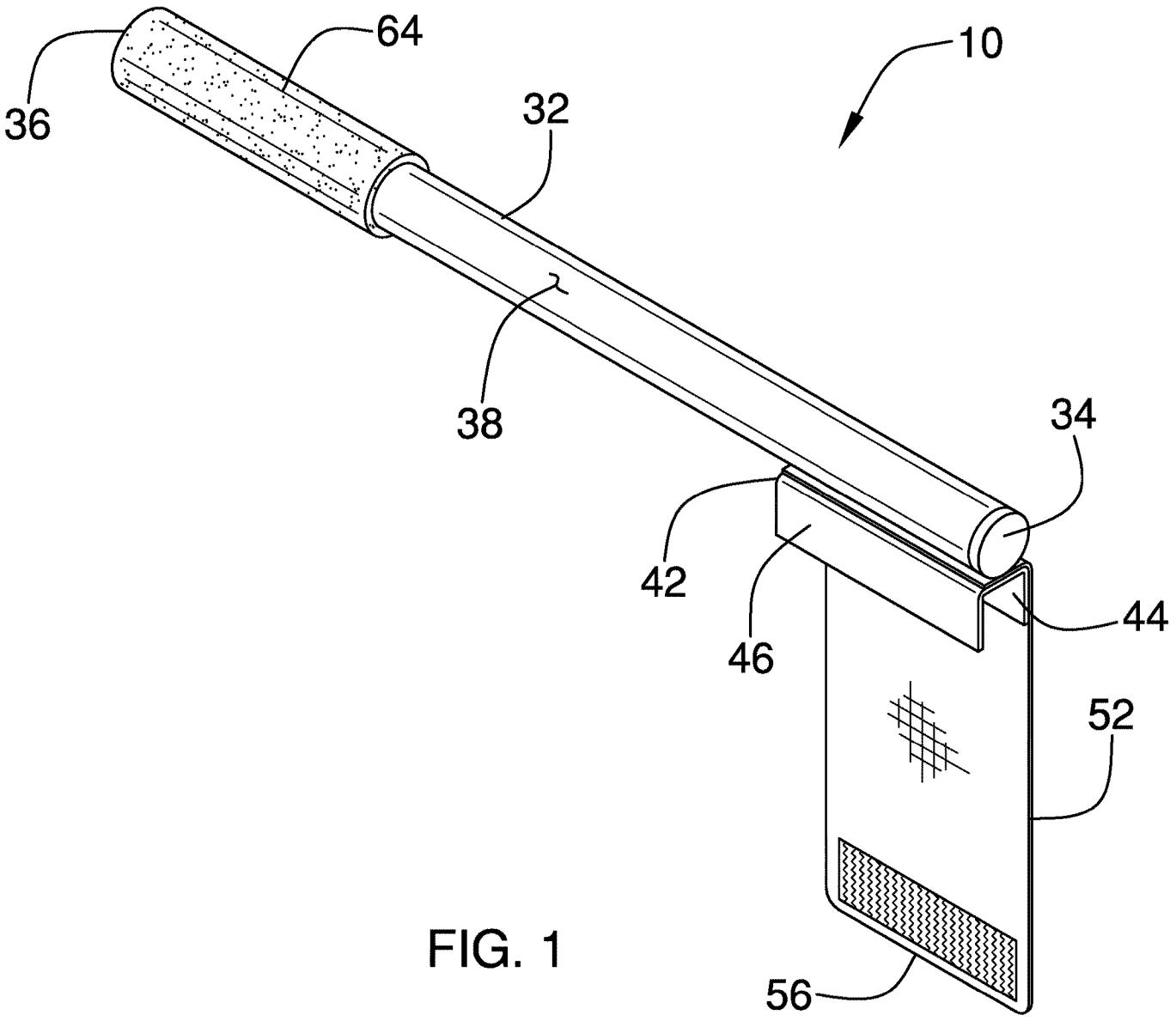
FIG. 1 is a rear isometric view of a luggage handle lateral displacement assembly according to an embodiment of the disclosure.

With reference now to the drawings, and in particular to FIGS. 1 through 5 thereof, a new luggage handle extension device embodying the principles and concepts of an embodiment of the disclosure and generally designated by the reference numeral 10 will be described.

As best illustrated in FIGS. 1 through 5, the luggage handle lateral displacement assembly 10 generally comprises a device that is used with a conventional suitcase 12 that has a front wall 14, a rear wall 16, a top wall 18 and a bottom wall 20. A plurality of wheels 22 will typically be attached to the bottom wall 20. A handle 24 is attached to the suitcase and extends upwardly from a top wall 18 of the suitcase 12. The "handle" as defined herein, will most often be the handle 24 that is attached to the suitcase 12 by way of extendable or telescopic supports 26 which allow the handle 24 to be selectively positioned vertically above the top wall 18. The handle 24 is positioned between a first lateral wall 28 and a second lateral wall 30 of the suitcase 12 and is elongated along a line extending between the first 28 and second 30 lateral walls.

A rod 32 has a first end 34, a second end 36 and a perimeter wall 38 extending between the first 34 and second 36 ends. The rod 32 has a length from the first end 34 to the second end 36 that is greater than 6.0 inches and is less than 18.0 inches and will generally have a length equal to about 12.0 inches. More, specifically, the rod 32 will have a length that is at least equal or greater than ½ of a distance from the first lateral wall 28 to the second lateral wall 30. The rod 32 has a greatest diameter that is less than 2.0 inches and greater than 0.50 inches. Typically, the rod 32 will have a cylindrical shape, though the rod 32 may have a rectangular cross-section.

Figure 4:
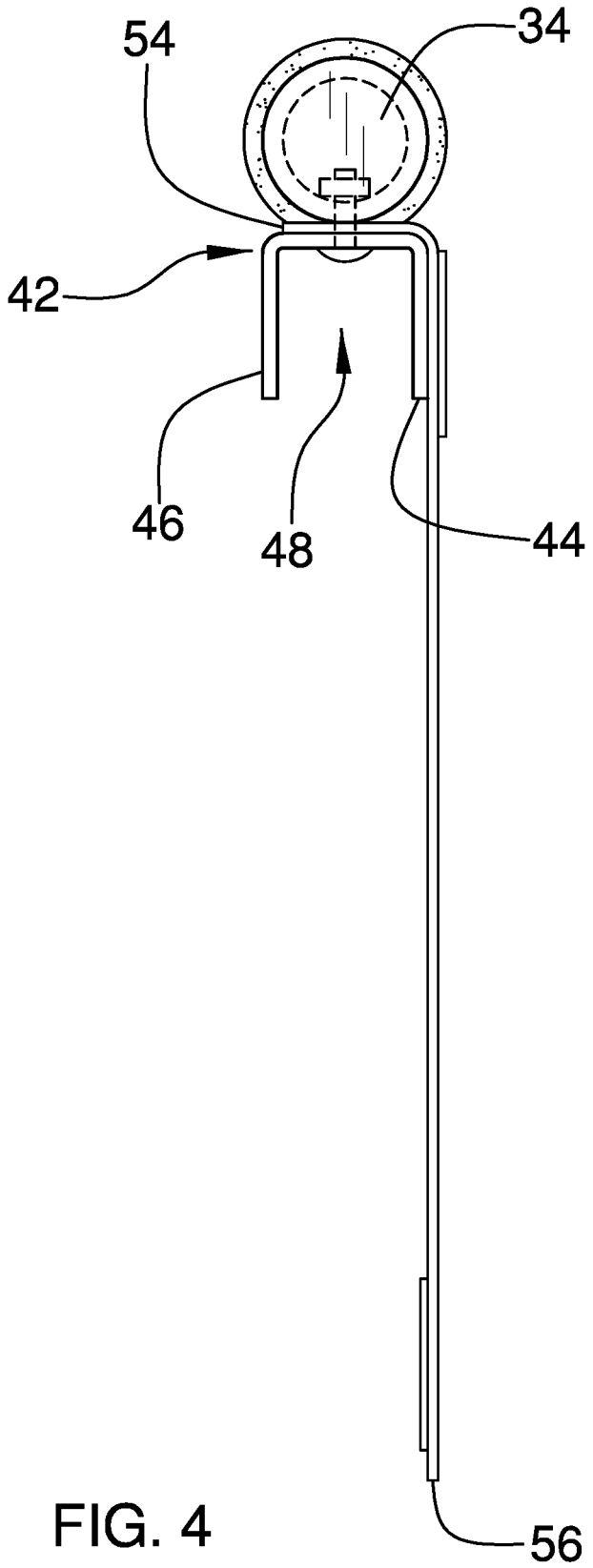
FIG. 4 is a side view of an embodiment of the disclosure.

A coupler 40 is attached to the rod 32 adjacent to the first end 34 and is mounted on the perimeter wall 38. The coupler 40 may be attached to the perimeter wall 38 with one or more fasteners as shown in FIG. 4 or may be bounded or adhered to the rod 32. The coupler 40 is configured to engage the handle 24 attached to the suitcase 12 such that the second end 36 extends laterally away from the handle 24. The coupler 40 includes a saddle 42 for receiving the handle 24. The saddle 42 is attached to the perimeter wall 38 adjacent to the first end 34 and extends toward the second end 36. The saddle 42 includes a front wall 44 and a rear wall 46 that are spaced from each other by a receiving space 48. The front 44 and rear 46 walls each lie in a plane oriented parallel to a longitudinal axis of the rod 32 extending through the first 34 and second 36 ends. The receiving space 48 is configured to receive the handle 24. The saddle 42 may be comprised of a resiliently bendable material such as elastomers, plastics, composite materials, aluminum, or plastics which will allow the saddle 42 to frictionally engage and such that the handle 24 is firmly held by the saddle 42.

Figure 2:
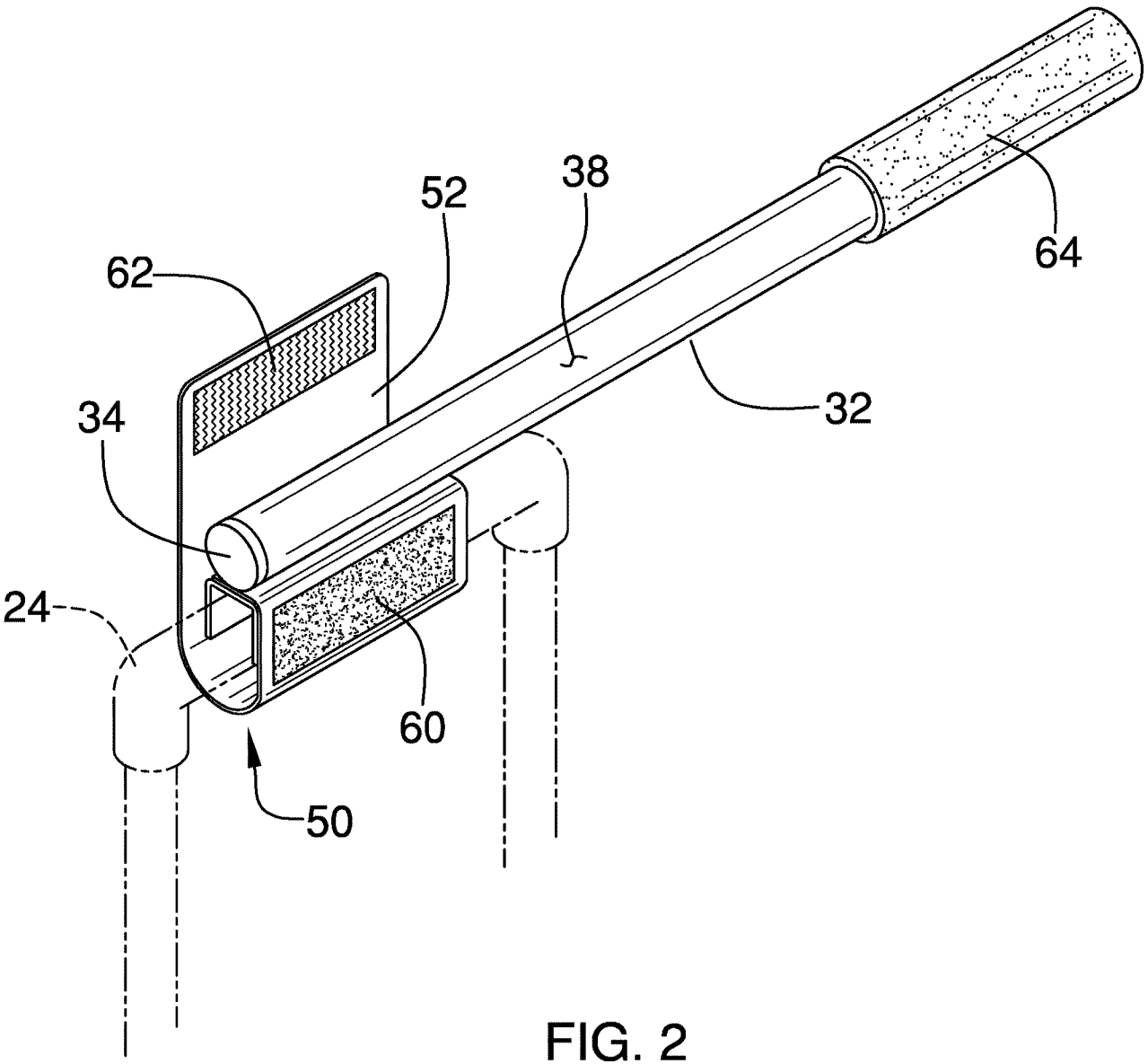
FIG. 2 is a front isometric view of an embodiment of the disclosure.
Figure 3:
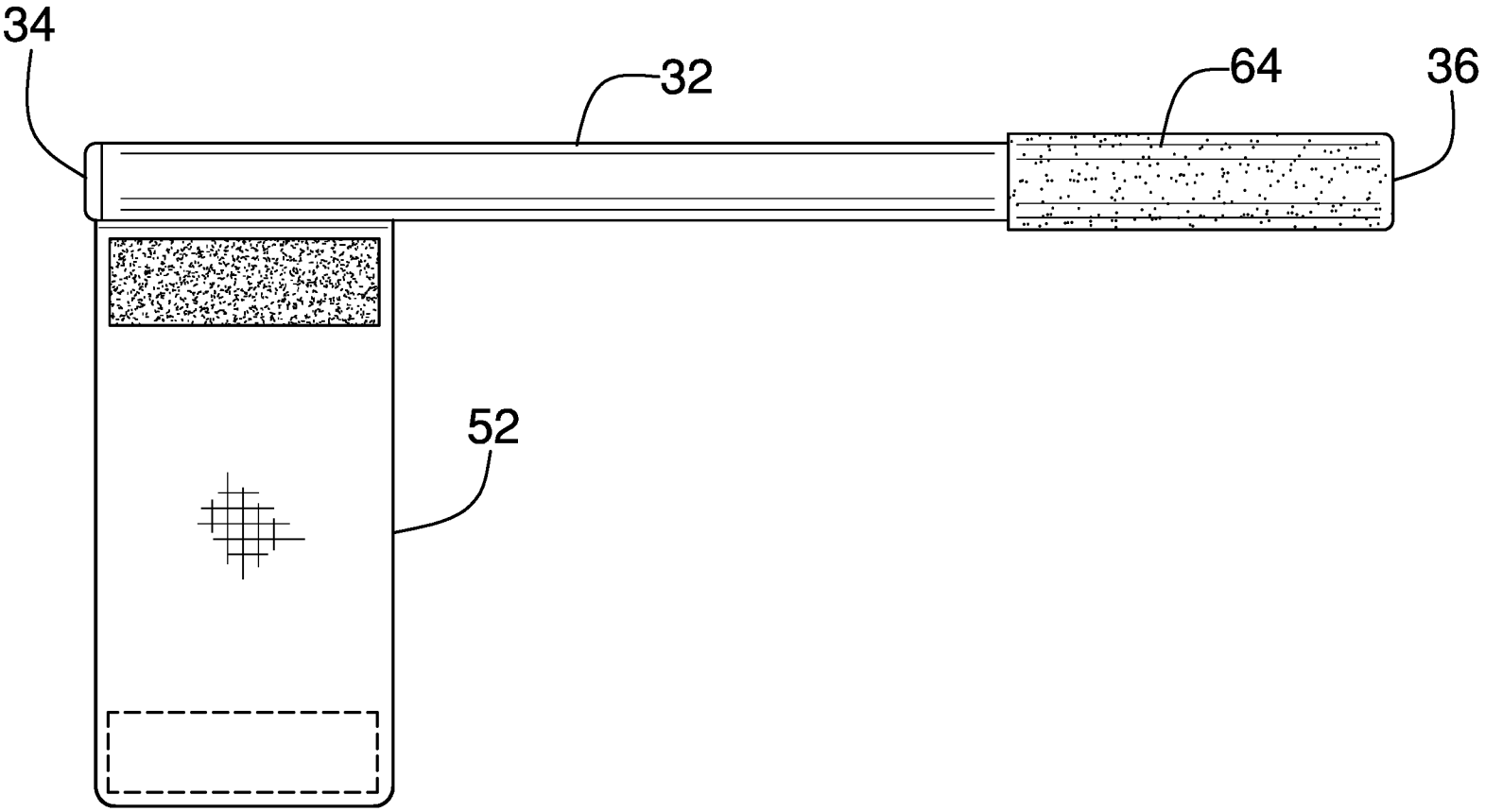
FIG. 3 is a front view of an embodiment of the disclosure.

The coupler 40 further includes a securing member 50 that is configured to retain the handle 24 in the saddle 42. In one embodiment, the securing member 50 comprises a panel 52 of flexible material, such as leather, natural fibers or synthetic fibers, and has an attached end 54 attached to the rod 32 or saddle 42 and a free end 56 positioned distal to the attached end 54. The panel 52 is extendable around the saddle 42 and the handle 24 to releasably retain the handle 24 in engagement with the saddle 42. The panel 52 may have a length to allow extension around the handle 42 and rod 32. A fastener 58 is mounted on the securing member 50 to releasably secure the free end 56 in a closed condition with the saddle 42 engaged with the handle 24. The fastener 58 may comprise snaps, buttons and the like. In FIG. 2, the fastener 58 is shown to be hook and loop fastener having a first mating member 60 positioned on the panel 52 adjacent to the attached end 54 and a second mating member 62 positioned on the panel 52 adjacent to the free end 56. The first 60 and second 62 mating members engage each other when the panel 52 is fully extended around the handle 24, saddle 42, and rod 32.

A grip 64 is attached to the rod 32 adjacent to the second end 36. The grip 64 extends around the perimeter wall 38 and may comprise a resiliently compressible material.

Figure 5:
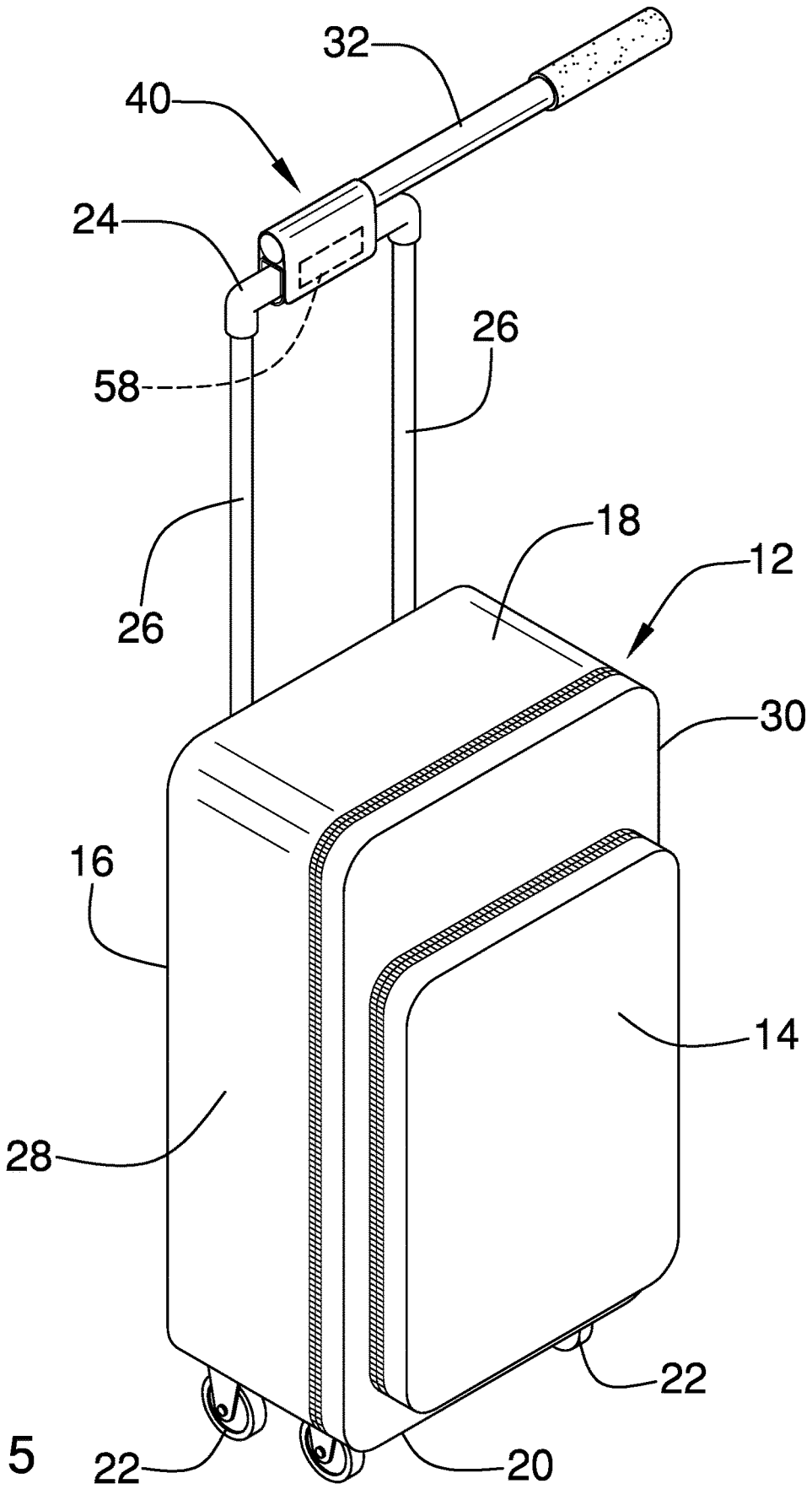
FIG. 5 is a front isometric in-use view of an embodiment of the disclosure.

In use, the coupler 40 is attached to the handle 24 as described above and as shown in FIGS. 2 and 5. The coupler 40 orients the rod 32 along a line that intersects planes of the first 28 and second 30 lateral walls. As shown in FIG. 5, the rod 32 extends outwardly away from the second lateral wall 30 such that when the rod 32 is gripped, adjacent to the second end 36, the suitcase 12 will be displaced laterally away from the user of the assembly 10. Thus, the suitcase 12 will not inadvertently strike the user's legs when the user rolls the suitcase 12 over a floor surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A suitcase handle extension assembly configured to engage a handle of a suitcase and facilitate lateral displacement of the handle, the assembly comprising:

a rod having a first end, a second end and a perimeter wall extending between the first and second ends, the rod being elongated between the first end and the second end; and a coupler being attached to the rod adjacent to the first end and being mounted on the perimeter wall, the coupler being configured to engage a handle attached to a suitcase such that the second end extends laterally away from the handle, wherein the coupler includes:

a saddle for receiving the handle, the saddle being elongated, the saddle being oriented such that a longitudinal axis of the saddle is parallel to a longitudinal axis of the rod, the saddle being attached to the perimeter wall adjacent to the first end and extending toward the second end whereby the saddle is configured to receive a cross member of the handle; and a securing member being configured to retain the handle in the saddle.

2. The suitcase handle extension assembly according to claim 1, wherein the rod has a length from the first end to the second end being greater than 6.0 inches and being less than 18.0 inches.

3. The suitcase handle extension assembly according to claim 2, wherein the rod has a greatest diameter being less than 2.0 inches and greater than 0.50 inches.

4. The suitcase handle extension assembly according to claim 3, wherein the rod has a cylindrical shape.

5. The suitcase handle extension assembly according to claim 1, wherein the saddle includes a front wall and a rear wall being spaced from each other by a receiving space, the front and rear walls each lying in a plane oriented parallel to the longitudinal axis of the rod extending through the first and second ends, the receiving space being configured to receive the handle.

6. The suitcase handle extension assembly according to claim 5, wherein the saddle is comprised of a resiliently bendable material.

7. The suitcase handle extension assembly according to claim 1, wherein the securing member comprises a panel of flexible material having an attached end attached to the rod and a free end positioned distal to the attached end, the panel being extendable around the saddle and the handle to releasably retain the handle in engagement with the saddle, a fastener being mounted on the securing member to releasably secure the free end in a closed condition having the saddle engaged with the handle.

8. A suitcase handle extending system comprising:

a suitcase having a front wall, a rear wall, a top wall and a bottom wall, a plurality of wheels being attached to the bottom wall, a handle being attached to the suitcase and extending upwardly from a top wall of the suitcase, the handle being positioned between a first lateral wall and a second lateral wall of the suitcase, the handle being elongated along a line extending between the first and second lateral walls;

a rod having a first end, a second end and a perimeter wall extending between the first and second ends, the rod being elongated between the first end and the second end, the rod having a length from the first end being at least equal to or greater than ½ of a distance from the first lateral wall to the second lateral wall; and a coupler being attached to the rod adjacent to the first end and being mounted on the perimeter wall, the coupler engaging the handle such that the second end extends laterally away from the handle, wherein the coupler includes:

a saddle for receiving the handle, the saddle being elongated, the saddle being oriented such that a longitudinal axis of the saddle is parallel to a longitudinal axis of the rod, the saddle being attached to the perimeter wall adjacent to the first end and extending toward the second end whereby the saddle receives a cross member of the handle; and a securing member retaining the handle in the saddle.

9. The suitcase handle extending system according to claim 8, wherein the rod has a length from the first end to the second end being greater than 6.0 inches and being less than 18.0 inches.

10. The suitcase handle extending system according to claim 9, wherein the rod has a greatest diameter being less than 2.0 inches and greater than 0.50 inches.

11. The suitcase handle extending system according to claim 10, wherein the rod has a cylindrical shape.

12. The suitcase handle extending system according to claim 8, wherein the saddle includes a front wall and a rear wall being spaced from each other by a receiving space, the front and rear walls each lying in a plane oriented parallel to the longitudinal axis of the rod extending through the first and second ends, the receiving space receiving the handle.

13. The suitcase handle extending system according to claim 12, wherein the saddle is comprised of a resiliently bendable material.

14. The suitcase handle extending system according to claim 13, wherein the securing member comprises a panel of flexible material having an attached end attached to the rod and a free end positioned distal to the attached end, the panel being extendable around the saddle and the handle to releasably retain the handle in engagement with the saddle, a fastener being mounted on the securing member to releasably secure the free end in a closed condition having the saddle engaged with the handle.

15. The suitcase handle extending system according to claim 11, wherein the saddle includes a front wall and a rear wall being spaced from each other by a receiving space, the front and rear walls each lying in a plane oriented parallel to the longitudinal axis of the rod extending through the first and second ends, the receiving space receiving the handle.

16. The suitcase handle extending system according to claim 15, wherein the securing member comprises a panel of flexible material having an attached end attached to the rod and a free end positioned distal to the attached end, the panel being extendable around the saddle and the handle to releasably retain the handle in engagement with the saddle, a fastener being mounted on the securing member to releasably secure the free end in a closed condition having the saddle engaged with the handle.

17. A suitcase handle extension assembly configured to engage a handle and facilitate lateral displacement of the handle, the assembly comprising:

a rod having a first end, a second end and a perimeter wall extending between the first and second ends, the rod being elongated between the first end and the second end, the rod having a length from the first end to the second end being greater than 6.0 inches and being less than 18.0 inches, the rod having a greatest diameter being less than 2.0 inches and greater than 0.50 inches, the rod having a cylindrical shape;

a coupler being attached to the rod adjacent to the first end and being mounted on the perimeter wall, the coupler being configured to engage a handle attached to a suitcase such that the second end extends laterally away from the handle, the coupler including:

a saddle for receiving the handle, the saddle being elongated, the saddle being oriented such that a longitudinal axis of the saddle is parallel to a longitudinal axis of the rod, the saddle being attached to the perimeter wall adjacent to the first end and extending toward the second end whereby the saddle receives a cross member of the handle, the saddle being attached to the perimeter wall adjacent to the first end and extending toward the second end, the saddle including a front wall and a rear wall being spaced from each other by a receiving space, the front and rear walls each lying in a plane oriented parallel to a longitudinal axis of the rod extending through the first and second ends, the receiving space being configured to receive the cross member of the handle, the saddle being comprised of a resiliently bendable material; and a securing member being configured to retain the handle in the saddle, the securing member comprising a panel of flexible material having an attached end attached to the rod and a free end positioned distal to the attached end, the panel being extendable around the saddle and the handle to releasable retain the handle in engagement with the saddle, a fastener being mounted on the securing member to releasably secure the free end in a closed condition having the saddle engaged with the handle.

* * * * *